US005209473A

United States Patent [19]

Fisher

[11] Patent Number: 5,209,473

[45] Date of Patent: May 11, 1993

[54] SET OF GOLF CLUBS HAVING OVAL SHAPE CAVITY BACK

[75] Inventor: Lin Fisher, Dallas, Tex.

[73] Assignee: Foxbat, Inc., Dallas, Tex.

[21] Appl. No.: 512,950

[22] Filed: Apr. 23, 1990

[51] Int. Cl.[5] ..... A63B 53/04

[52] U.S. Cl. ..... 273/77 A; 273/169; 273/167 F

[58] Field of Search ..... 273/77 A, 167 R, 167 D, 273/167 F, 169

[56] References Cited

U.S. PATENT DOCUMENTS

| | | | |
|---|---|---|---|
| 3,655,188 | 4/1972 | Solheim | 273/167 F |
| 3,751,035 | 8/1973 | Lockwood | 273/167 F |
| 4,420,156 | 12/1983 | Campau | 273/77 A |
| 4,715,601 | 12/1987 | Lamanna | 273/77 A |
| 4,802,672 | 2/1989 | Long | 273/77 A |

*Primary Examiner*—V. Millin
*Assistant Examiner*—William M. Pierce

[57] ABSTRACT

A set of iron-type golf clubs including a predetermined number of clubs is disclosed with each club including a hosel portion with a shaft operatively inserted therein and a blade portion attached to the hosel portion. The blade includes a substantially planar face portion which is generally oval in shape, a back portion which is generally oval in shape and is disposed opposite the planar face portion. The back portion includes a cavity which is generally oval in shape. A torsion ring which is generally oval in shape completely surrounds the cavity and distributes the weight thereof around the perimeter of the cavity.

17 Claims, 2 Drawing Sheets

SET OF GOLF CLUBS HAVING OVAL SHAPE CAVITY BACK

BACKGROUND OF THE INVENTION

1. Field of the Invention

This invention relates generally to golf clubs of the type having iron heads for use on tees and in fairways. More particularly, but not by way of limitation, this invention relates to a new and improved structure of the head of the iron club.

2. Description of the Prior Art

A full set of golf irons typically include a set of eleven irons, numbered one (long) through nine (short), a pitching wedge and a sand wedge. Each iron comprises a head including a hosel and a shaft which is attached to the head by fitting the shaft into the bore of the hosel. A grip is fitted to the opposite end of the shaft from the head. The hosel is attached to and is integral with the head. The head includes a heel, a bottom sole, a toe, a planar striking face and a backside.

The eleven irons of a full set conventionally have varying degrees of loft angle and lie angle. The loft angle of an iron is the angle between a vertical plane, which includes the shaft, and the plane of the striking face of the iron. The lie angle of an iron is the angle between the shaft and the ground (horizontal plane) when the tangent to the sole directly under the center of mass is in the horizontal plane and when the shaft lies in a vertical plane.

The loft angle, as the name suggests, determines how much loft is imparted to the ball when it is struck by the tilted striking face. The lie angle of the iron assures that when swung properly, the sole of the iron will contact the ground evenly so that the striking face will not tend to twist inwardly or outwardly.

In a conventional set of irons, each iron has a number of horizontal grooves extending across the planar striking face. The horizontal grooves assist in providing back spin to the golf ball when struck by the planar striking face. When the planar striking face fails to impart back spin to the ball, the ball may flutter and not fly as far as anticipated and will not hold (bite) the playing surface upon landing.

For any set of golf irons, it is important that for a consistent swing, the iron impart consistent loft and distance to the ball. It is also important that when properly swung, the iron produces a consistent shot without a tendency to hook or slice.

Present day iron club designs fall into two general categories; first, the traditional type of design wherein the iron is referred to as the "muscle-back" design and has a generally continuous back portion on the club head; the second type of iron design is referred to as the "cavity-back" design wherein the back portion of the club head includes a substantial depression or cavity which has the effect of providing perimeter weighting for the club head. In contrast with the more conventional solid back iron, perimeter weighting normally provides a larger "sweet spot" or hitting area. That is to say, the cavity-back type of club head is rather forgiving and is designed so that the ball does not have to be struck precisely in the center of mass of the club head to attain acceptable results.

Thus, with present day designs, as we progress through a set of iron clubs starting with the lower lofted irons, the location of the center of mass moves outwardly along the club head away from the hosel and toward the toe of the club head. This variance in the location of the "sweet spot" is an undesirable feature that can adversely affect play. This phenomenon or disadvantage is present not only with the traditional muscle-back irons, but also with the cavity-back irons.

With a cavity-back type of iron, the present day designs utilize a relatively uniform cavity size or dimension from club to club. That is to say, the approximate volume of the cavity for a one-iron will be about the same as that for a nine-iron or pitching wedge. Since the weight of the club head increases as we progress through the clubs of the set, with the cavity volume remaining approximately constant, the increased mass of the club is normally accommodated at two locations. The increased weight is normally placed either on the sole of the club head, or proximate the toe of the club, or portion the weight to both locations. Consequently, there is provided a club head either with a relatively thick sole and/or an oversized, weighted toe portion. Both of these are undesirable features, especially in the higher lofted iron clubs. The placement of increased or excess weight in the sole of the club head causes the ball to fly higher than desired. The addition of weight at the toe location, especially in the higher lofted clubs, is also undesirable as this will cause the face of the club head to close during the golf swing. With the center of mass disposed relatively outwardly toward the toe, the closing of the face of the club head can produce errant shots, or at the very least, shots of lesser accuracy than is demanded, especially by the more skilled players of the game of golf.

SUMMARY OF THE INVENTION

The present invention provides a set of iron-type golf clubs of a predetermined number of clubs with each club including a hosel portion with a shaft operatively inserted therein and a blade portion attached to the hosel portion. The blade includes a substantially planar face portion which is generally oval in shape, a back portion which is generally oval in shape and is disposed opposite the planar face portion. The back portion includes a cavity which is generally oval in shape. A torsion ring which is generally oval in shape completely surrounds the cavity and distributes the weight thereof around the perimeter of the cavity.

BRIEF DESCRIPTION OF THE DRAWINGS

Other advantages and features of the invention will become more apparent with reference to the following detailed description of a presently preferred embodiment thereof in connection with the accompanying drawings, wherein like reference numerals have been applied to like elements, in which.

DESCRIPTION OF THE PREFERRED EMBODIMENT

Figure 1:
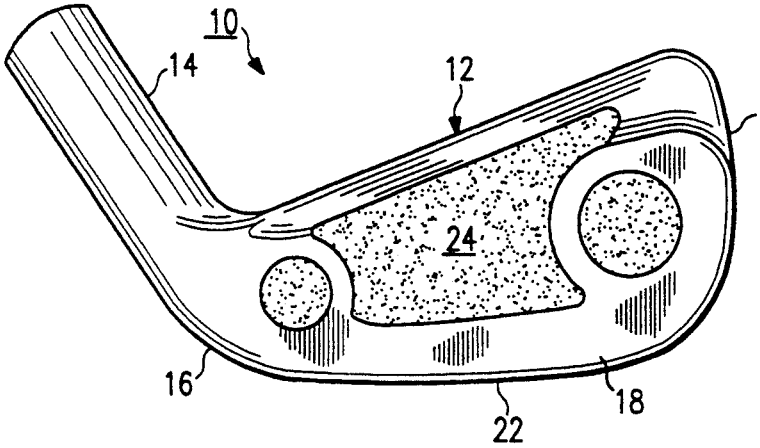
FIG. 1 (PRIOR ART)
FIG. 1 is a rear elevational view of a typical prior-art club head showing the general shape thereof.

Referring to the drawing and FIG. 1 in particular, shown therein and generally designated by the reference character 10 is an iron club head which is indicative of conventional prior-art iron club heads. The iron club head 10 includes a blade 12 having a hosel 14 attached thereto and integral therewith which extends away from the blade 12 at a predetermined angle. The hosel 14 is hollow to accept a shaft therein. Blade 12 includes a heel 16 which is formed to meet and blend with the hosel 14. Blade 12 also includes a back portion 18, a toe portion 20 and a sole portion 22, the latter being provided adjacent the lower edge of the blade 12. The back portion 18 is provided with a cavity 24. It will be appreciated that the increased weight has been placed in the toe portion 20 of blade 12 with the blade 12 being relatively long and with a high toe portion 20 containing a relatively large portion of the total weight of the blade with a resulting closing of the face of the club during the golf swing.

Figure 2:
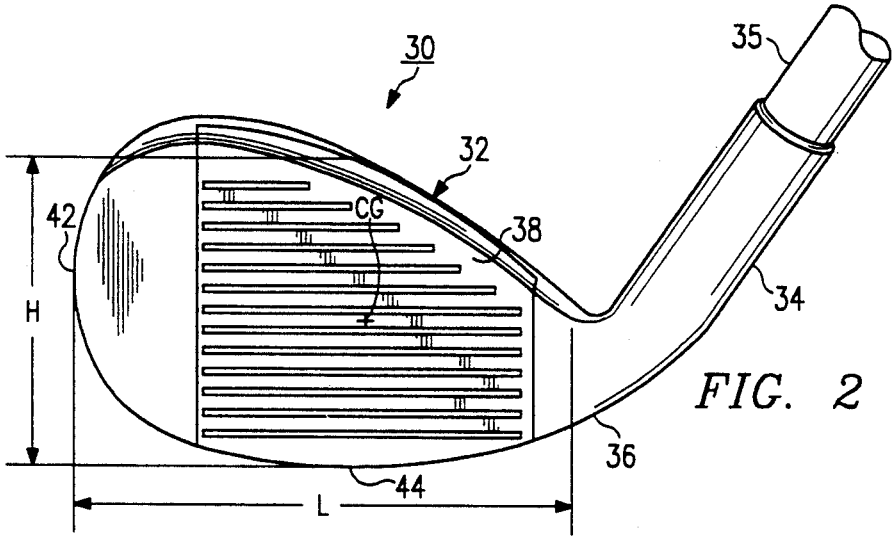
FIG. 2 is a front elevational view of a lower lofted club head, such as a three iron, constructed in accordance with the present invention.
Figure 3:
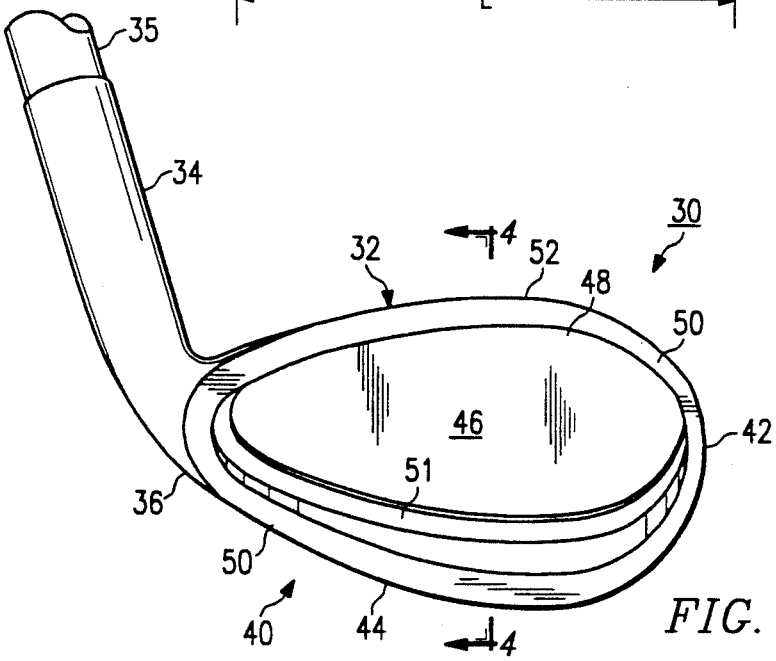
FIG. 3 is a rear elevational view of the club head shown in FIG. 2.

Referring now to FIGS. 2 and 3 in particular, shown therein and generally designated by the reference character 30 is an iron club head constructed in accordance with the present invention. Although it is customary to have a full or complete set of clubs of the iron-type from a No. 1 through a sand wedge, particularly among professional or serious golfers, it is quite common for golfers to carry only Nos. 2 through pitching wedge and some golfers carry only a short set consisting of Nos. 3, 5, 7, 9 and a wedge. Accordingly, to illustrate a set of golf clubs in accordance with the present invention, only Nos. 3, 6 and pitching wedge are shown in the drawings, it being understood that the clubs of more complete sets may also be provided with the novel features of the clubs illustrated.

The inventive club head 30 comprises a blade or main body portion 32 having a hosel 34 attached thereto and integral therewith which extends away from the blade 32 at a predetermined angle. The hosel 34 is hollow to accept a shaft 35 therein. Blade 32 includes a heel 36 which is formed to meet and blend with the hosel 34. Blade 32 also includes a face portion 38 for striking a golf ball, a back portion 40, a toe portion 42 and a sole portion 44, the latter being provided adjacent the lower edge of the blade 32. The back portion 40 is provided with a cavity 46 including a floor portion 48. Cavity 46 is surrounded by a torsion ring 50 which is integral with the back portion 40. Partial ring or cresent-shaped ledge 51 provides means to make fine adjustments in positioning the location of the center-of-gravity (CG) in the club head 30.

The novel and inventive features of the club head 30 include the shape of the blade or main body portion 32 which is generally oval in shape. The face portion 38 conforms to the shape of an oval. The outer periphery of the cavity 46 conforms to the shape of an oval and the torsion ring 50 which surrounds the cavity 46 conforms to the shape of an oval. The outer surface of the torsion ring 50 extends outwardly from the floor portion 48 of cavity 46 an average of approximately 0.125 inches at the top edge portion 52 of the back portion 40 to an average of approximately 0.350 inches at the sole portion 44 of the back portion 40. The oval shape and design of the blade 32 and the cavity 46 combine with the oval shaped torsion ring 50 to improve the striking ability of the club head 30 and provide a consistency in trajectory and an increase of distance of the golf ball even in the event of off-center impact between the blade 32 and the golf ball.

The thickness of the striking surface (the distance between the face portion 38 and the floor portion 48 of cavity 46) is 0.130 inches. When the ball is struck by the blade 32, which is traveling approximately one hundred miles per hour, the face portion 38 (or striking surface) flexes for a millisecond of time (or less). At that time, force lines travel out from the cavity 46 in all directions until reaching the torsion ring 50, surrounding the cavity 46, which holds the outer edges of the cavity 46 very rigid. At that point in time, the torsion ring 50 returns essentially all of the energy back to the face portion 38 much the same as an attached right angle arm returns energy from the twisting action of a torsion bar. Only by configuring an iron club head with an oval face portion 38 (striking surface) supported by an oval cavity behind the oval face portion 38 which is surrounded by an adjacent oval ring 50 of much thicker metal relative to the thickness of the oval face portion 38, can the torsion ring effect be accomplished.

The oval iron club head 30 having an oval face portion 38, combined with an oval cavity 46 behind the oval face portion 38, surrounded by an oval torsion ring 50 makes optimal use of weight distribution in a set of golf irons. Traditionally, golf iron heads weigh approximately 234 grams in the No. 2 iron, increasing 7 grams per club to a 300 gram sand wedge. The prior art design insures weight distribution in the toe and heel of the golf club. Almost everyone agrees that the weights of currently produced golf clubs are correct, give or take a few grams on each club. The distribution of the weight in the oval iron of the present invention greatly improves the launch performance and consistency of the golf ball. In the oval iron, the weight is around the complete face portion 38 in a uniform fashion. When the golf ball is struck by the blade 32, the oval torsion ring 50 stabilizes the flexing of the rather thin striking surface and thereby stabilizes the golf club so as to impart a very solid feel to the player, even with off-center hits. Prior art clubs have a cavity in the back portion but the weight of the club head was never distributed around the cavity equally because the golf club was configured to have a greater portion of the weight of the club out in the toe portion.

Another feature of the oval club head 30 is the oval shaped curve of the sole portion 44. The lowest point of turf drag or the lowest point at which the golf club contacts the fairway turf is in the center of the oval curve, the bottom of the oval curve. On conventional golf clubs with the sole portion being generally flat, the lowest point of turf drag might occur on the heel of the club causing the club face to close or on the toe of the club causing the club face to open.

The oval iron club head 30 has a delayed moment of inertia because the oval configuration removes 45 grams of weight from the toe portion of the club head and redistributes that 45 grams of weight to the oval torsion ring 50 that surrounds the cavity 46. When a player addresses the golf ball, the club head is positioned directly behind the golf ball perpendicular to the intended line of flight of the golf ball. When the player is swinging the golf club, the orbit of the golf club head is inclined an average of 45 degrees. It is desirable that the club head remain square to the orbit inclination, or remain in the same relative position, during the swing as it was at the beginning of the swing. Only by a delayed moment of inertia can the club head remain on the desired angle relative to the pre-established inclination of the club at the start of the swing. The removal of the weight from the toe portion of the club head reduces the oscillating effect of the golf club so the leading edge of the striking surface is perpendicular to the intended line of flight when the striking surface of the club head strikes the golf ball.

By way of example, there is included hereinafter a table illustrating certain features of the oval iron club head 30 of a typical set of clubs constructed in accordance with the present invention. In this regard, there is included the height H of the face portion at the center-of-gravity CG point on the face portion 38 and the length L of the flat section of the face portion 38 for each club of a complete set.

| CLUB NO. | LENGTH L OF FLAT PORTION (INCHES) | HEIGHT H OF CENTER OF LENGTH (INCHES) | H/L |
|---|---|---|---|
| 1 | 3.085 | 1.948 | 0.6314 |
| 2 | 3.130 | 1.966 | 0.6282 |
| 3 | 3.130 | 2.000 | 0.6390 |
| 4 | 3.112 | 2.038 | 0.6549 |
| 5 | 3.058 | 2.105 | 0.6884 |
| 6 | 3.057 | 2.142 | 0.7007 |
| 7 | 2.958 | 2.224 | 0.7519 |
| 8 | 2.978 | 2.275 | 0.7639 |
| 9 | 3.060 | 2.310 | 0.7549 |
| PW | 3.014 | 2.375 | 0.7880 |
| SW | 3.015 | 2.405 | 0.7977 |

Figure 4:
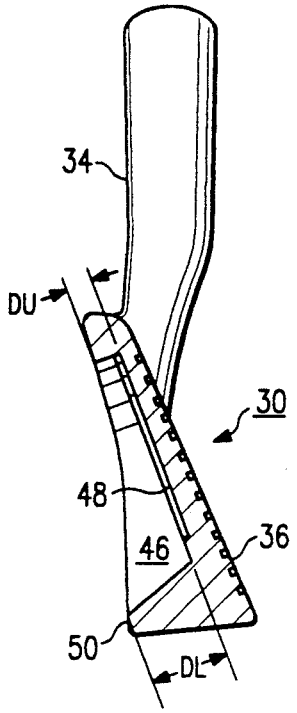
FIG. 4 is a sectional view of the club head taken along line 4—4 of FIG. 3.

FIG. 4 is a sectional view of the oval club head 30 taken along line 4—4 of FIG. 3 and shows the relative size of the torsion ring 50 and position around the cavity 46.

Also by way of example, there is included hereinafter a table illustrating certain additional features of the oval iron club head 30 of a typical set of clubs constructed in accordance with the present invention. In this regard, there is included the distance DU the torsion ring 50 extends or protrudes outwardly from the floor portion 48 measured at the upper portion of the cavity 46 above and in-line with the CG. There is also included the distance DL the torsion ring 50 extends or protrudes outwardly from the floor portion 48 measured at the lower portion of the cavity 46 below and in-line with the CG.

| CLUB NO. | DISTANCE DU (INCHES) | DISTANCE DL (INCHES) |
|---|---|---|
| 1 | 0.140 | 0.360 |
| 2 | 0.140 | 0.360 |
| 3 | 0.140 | 0.370 |
| 4 | 0.130 | 0.360 |
| 5 | 0.130 | 0.370 |
| 6 | 0.130 | 0.340 |
| 7 | 0.125 | 0.325 |
| 8 | 0.125 | 0.325 |
| 9 | 0.110 | 0.380 |
| PW | 0.110 | 0.380 |
| SW | 0.110 | 0.380 |

Figure 5:
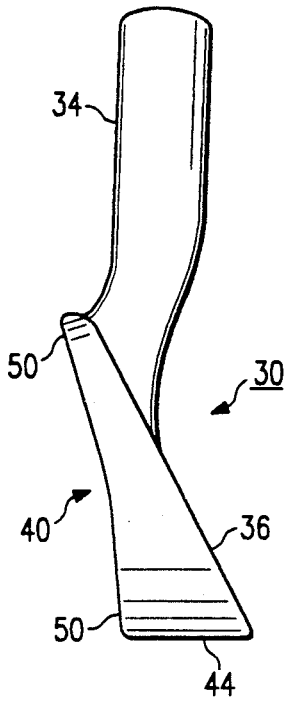
FIG. 5 is a toe end elevational view of a middle lofted club head, such as a six iron, constructed in accordance with the present invention.

FIG. 5 is a toe end elevational view of a six iron showing the shape of the oval club head 30 from the toe end of the club.

Figure 7:
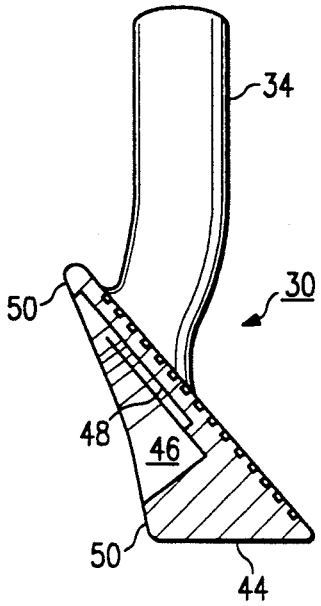
FIG. 7 is a sectional view of the club head taken along line 7—7 of FIG. 6.
Figure 6:
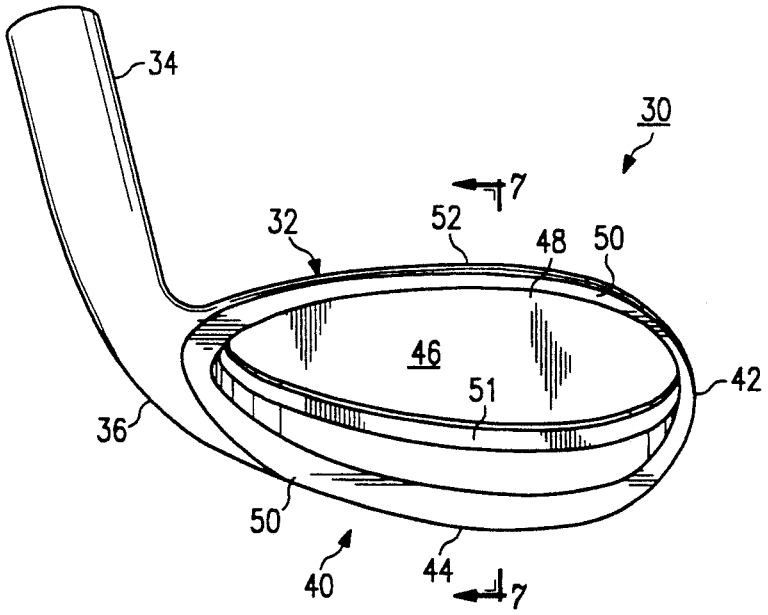
FIG. 6 is a rear elevational view of a higher lofted club head, such as a pitching wedge, constructed in accordance with the present invention.

With reference to FIGS. 6 and 7, it will be appreciated that the torsion ring 50 is wider and deeper for the more lofted clubs. The oval club head 30 is formed from 17-4 stainless steel.

It will be appreciated that the present invention comprises a unique golf club head with a torsion ring whose weight is distributed completely around the cavity to provide an improvement in launch performance and consistency of the golf ball as well as a more solid feel to the player when striking the golf ball.

Although the present invention has been described with reference to a presently preferred embodiment, it will be appreciated by those skilled in the art that various modifications, alternatives, variations, etc., may be made without departing from the spirit and scope of the invention as defined in the appended claims.

I claim:

1. A set of iron-type golf clubs including a predetermined number of clubs, each club including a shaft and a club head, each club head comprising:

a hosel portion; and a blade portion attached to said hosel portion; said blade portion comprising:

a substantially planar face portion for striking a ball which is generally oval in shape;

a back portion which is generally oval in shape and is disposed opposite said substantially planar face, said back portion including a cavity which is generally oval in shape, having an upper central portion and a lower central portion and includes a floor portion;

a torsion ring which is generally oval in shape and completely surrounds said cavity and evenly distributes the weight thereof around said cavity;

whereby the substantially planar face, upon striking a golf ball, will flex and distribute energy forces out to the torsion ring which will return the energy forces back to the substantially planar face to propel the golf ball from the substantially planar face.

2. The set of iron-type golf clubs of claim 1 wherein said substantially planar face portion comprises a measurement L of predetermined length of a substantially flat surface and a measurement H of predetermined height at the center of measurement L.

3. The claim of iron-type golf clubs of claim 2 wherein measurement L and measurement H are:

| CLUB NO. | LENGTH OF FLAT PORTION (INCHES) | HEIGHT OF CENTER OF LENGTH (INCHES) |
|---|---|---|
| 1 | 3.085 | 1.948 |
| 2 | 3.130 | 1.966 |
| 3 | 3.130 | 2.000 |
| 4 | 3.112 | 2.038 |
| 5 | 3.058 | 2.105 |
| 6 | 3.057 | 2.142 |
| 7 | 2.958 | 2.224 |
| 8 | 2.978 | 2.275 |
| 9 | 3.060 | 2.310 |
| PW | 3.014 | 2.375 |
| SW | 3.015 | 2.405 |

4. The set of iron-type golf clubs of claim 2 wherein the ratio of measurement H to measurement L is:

| CLUB NO. | H/L |
|---|---|
| 1 | 0.6314 |
| 2 | 0.6282 |
| 3 | 0.6390 |
| 4 | 0.6549 |
| 5 | 0.6884 |
| 6 | 0.7007 |
| 7 | 0.7519 |
| 8 | 0.7639 |
| 9 | 0.7549 |
| PW | 0.7880 |
| SW | 0.7977 |

5. The set of iron-type golf clubs of claim 1 wherein said each club head includes a center-of-gravity.

6. The set of iron-type golf clubs of claim 5 further including means for adjusting the location of the center of gravity of said club head, said means for adjusting comprises a cresent-shaped ledge positioned at the lower central portion of said cavity.

7. The set of iron-type golf clubs of claim 5 wherein said torsion ring comprises a measurement DU of the distance said torsion ring extends outwardly from the floor portion of said cavity at the upper central portion of said cavity above and in-line with the center-of-gravity.

8. The set of iron-type golf clubs of claim 7 wherein said torsion ring comprises a measurement DL of the distance said torsion ring extends outwardly from the floor portion of said cavity at the lower central portion of said cavity below and in-line with the center-of-gravity.

9. The set of iron-type golf clubs of claim 8 wherein measurement DU and measurement DL are:

| CLUB NO. | DISTANCE DU (INCHES) | DISTANCE DL (INCHES) |
|---|---|---|
| 1 | 0.140 | 0.360 |
| 2 | 0.140 | 0.360 |
| 3 | 0.140 | 0.370 |
| 4 | 0.130 | 0.360 |
| 5 | 0.130 | 0.370 |
| 6 | 0.130 | 0.340 |
| 7 | 0.125 | 0.325 |
| 8 | 0.125 | 0.325 |
| 9 | 0.110 | 0.380 |
| PW | 0.110 | 0.380 |
| SW | 0.110 | 0.380 |

10. A set of iron-type golf clubs including a predetermined number of clubs, each club including a shaft and a club head, each club head comprising:

a hosel portion; and a blade portion attached to said hosel portion; said blade portion comprising:

a substantially planar face portion for striking a ball which is generally oval in shape and having a toe portion, a heel portion, a top edge portion and a lower sole portion, said top edge portion forming a curved surface between said toe portion and said heel portion and said lower sole portion forming a curved surface between said toe portion and said heel portion;

a back portion which is generally oval in shape and is disposed opposite said substantially planar face, said back portion including a cavity which is generally oval in shape, having an upper central portion and a lower central portion and includes a floor portion;

a torsion ring which is generally oval in shape and completely surrounds said cavity and evenly distributes the weigh thereof around said cavity;

whereby the substantially planar face, upon striking a golf ball, will flex and distribute energy forces out to the torsion ring which will return the energy forces back to the substantially planar face to propel the golf ball from the substantially planar face.

11. The set of iron-type golf clubs of claim 10 wherein said each club head includes a center-of-gravity.

12. The set of iron-type golf clubs of claim 11 further including means for adjusting the location of the center of gravity of said club head, said means for adjusting comprises a cresent-shaped ledge positioned at the lower central portion of said cavity.

13. The set of iron-type golf clubs of claim 12 wherein said torsion ring comprises a measurement DU of the distance said torsion ring extends outwardly from the floor portion of said cavity at the upper central portion of said cavity above and in-line with the center-of-gravity.

14. The set of iron-type golf clubs of claim 13 wherein said torsion ring comprises a measurement DL of the distance said torsion ring extends outwardly from the floor portion of said cavity at the lower central portion of said cavity below and in-line with the center-of-gravity.

15. A set of iron-type golf clubs including a predetermined number of clubs, each club including a shaft and a club head, each club head comprising:

a hosel portion; and a blade portion attached to said hosel portion; said blade portion comprising:

a substantially planar face portion for striking a ball which is generally oval in shape and having a toe portion, a heel portion, a top edge portion and a lower sole portion, said top edge portion forming a curved surface between said toe portion and said heel portion and said lower sole portion forming a curved surface between said toe portion and said heel portion;

a back portion which is generally oval in shape and is disposed opposite said substantially planar face, said back portion including a cavity which is generally oval in shape, having an upper central portion and a lower central portion and includes a floor portion;

a torsion ring which is generally oval in shape and completely surrounds said cavity and evenly distributes the weight thereof around said cavity;

a center of gravity;

means for adjusting the location of the center of gravity of said club head, said means for adjusting comprises a cresent-shaped ledge positioned at the lower central portion of said cavity;

whereby the substantially planar face upon striking a golf ball, will flex and distribute energy forces out to the torsion ring which will return the energy forces back to the substantially planar face to propel the golf ball from the substantially planar face.

16. The set of iron-type golf clubs of claim 15 wherein said torsion ring comprises a measurement DU of the distance said torsion ring extends outwardly from the floor portion of said cavity at the upper central portion of said cavity above and in-line with the center-of-gravity.

17. The set of iron-type golf clubs of claim 16 wherein said torsion ring comprises a measurement DL of the distance said torsion ring extends outwardly from the floor portion of said cavity at the lower central portion of said cavity below and in-line with the center-of-gravity.

* * * * *